US005690585A

United States Patent [19]

Ditsch

[11] Patent Number: 5,690,585

[45] Date of Patent: Nov. 25, 1997

[54] HAND DEVELOPMENT APPARATUS

[75] Inventor: John R. Ditsch, Bolingbrook, Ill.

[73] Assignee: HDS, Inc., Bolingbrook, Ill.

[21] Appl. No.: 590,164

[22] Filed: Jan. 23, 1996

[51] Int. Cl.[6] ..... A63B 23/16

[52] U.S. Cl. ..... 482/47; 482/49; 482/121; 482/908

[58] Field of Search ..... 482/44, 47, 49, 482/121, 122, 128, 908; 601/40; 73/379.02, 379.03, 379.01

[56] References Cited

U.S. PATENT DOCUMENTS

| | | | |
|---|---|---|---|
| D. 261,552 | 10/1981 | Boroda . | |
| D. 294,614 | 3/1988 | Ditsch et al. . | |
| 1,136,481 | 4/1915 | Ostrovsky | 482/47 |
| 1,229,658 | 6/1917 | Sandow . | |
| 2,930,614 | 3/1960 | McIntosh | 482/126 |
| 3,129,939 | 4/1964 | Stock . | |
| 3,447,415 | 6/1969 | Kime . | |
| 3,583,394 | 6/1971 | Napoli et al. | 601/40 |
| 3,738,651 | 6/1973 | Norman et al. . | |
| 4,678,181 | 7/1987 | Ditsch et al. . | |
| 5,431,611 | 7/1995 | Silagy | 482/47 |
| 5,533,949 | 7/1996 | Hwang | 482/47 |

FOREIGN PATENT DOCUMENTS

| | | | |
|---|---|---|---|
| 3630438 | 3/1988 | Germany | 482/49 |
| 1660709 | 7/1991 | U.S.S.R. | 482/47 |

*Primary Examiner*—Jeanne M. Clark
*Attorney, Agent, or Firm*—Marshall, O'Toole, Gerstein, Murray & Borun

[57] ABSTRACT

A hand development apparatus is provided with a first housing having an interior cavity formed therein and a gripping portion adapted to fit the palm of a person's hand and a second housing having an interior cavity formed therein and a gripping portion adapted to fit the palm of a person's hand. The apparatus has a carrier adapted to be removably fitted within the interior cavity of the first housing or within the interior cavity of the second housing, a plurality of movable elements associated with the carrier, the movable elements being adapted to accommodate the fingers of a person's hand and being movable along a movement direction, and springs for resisting movement of the movable elements along the movement direction. The width of the first housing is substantially different than the width of the second housing so that the apparatus may be configured either for a person having relatively large hands or a person having relatively small hands. The movable elements may be provided in a staggered relationship when in their extended positions.

20 Claims, 2 Drawing Sheets

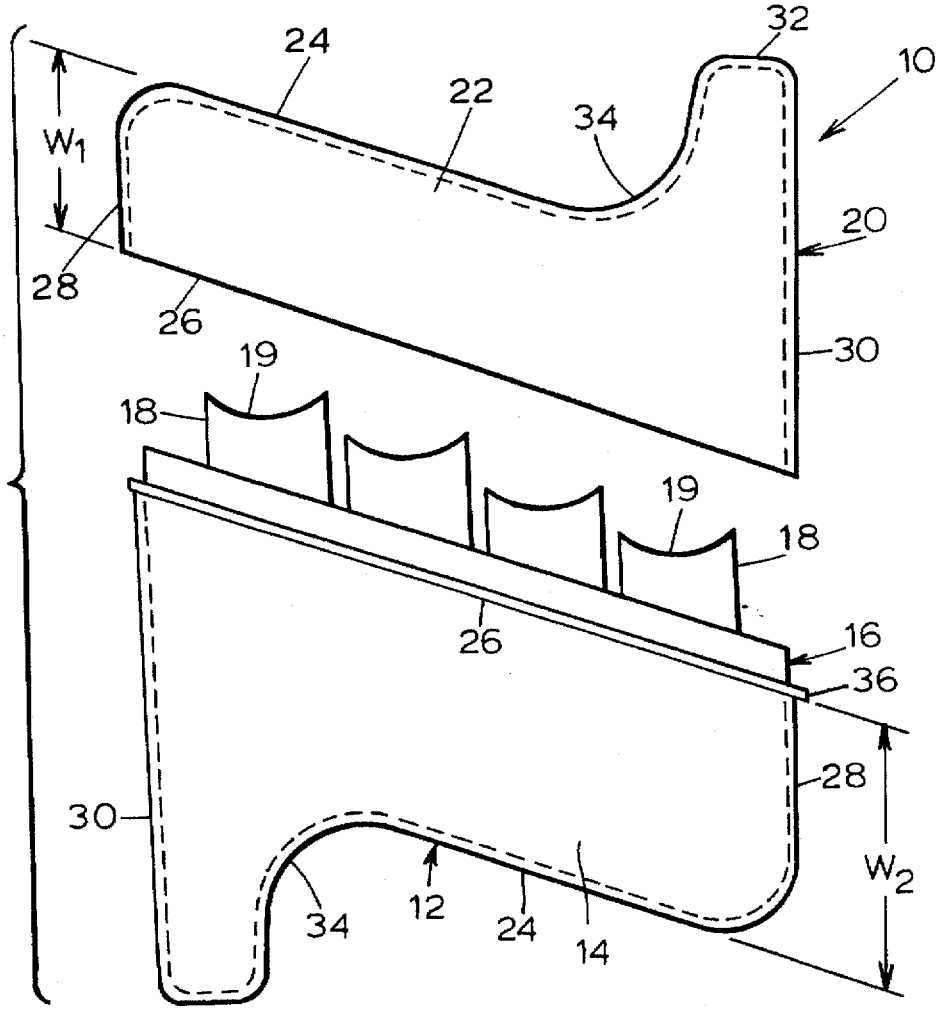
FIG. 1
FIG. 2
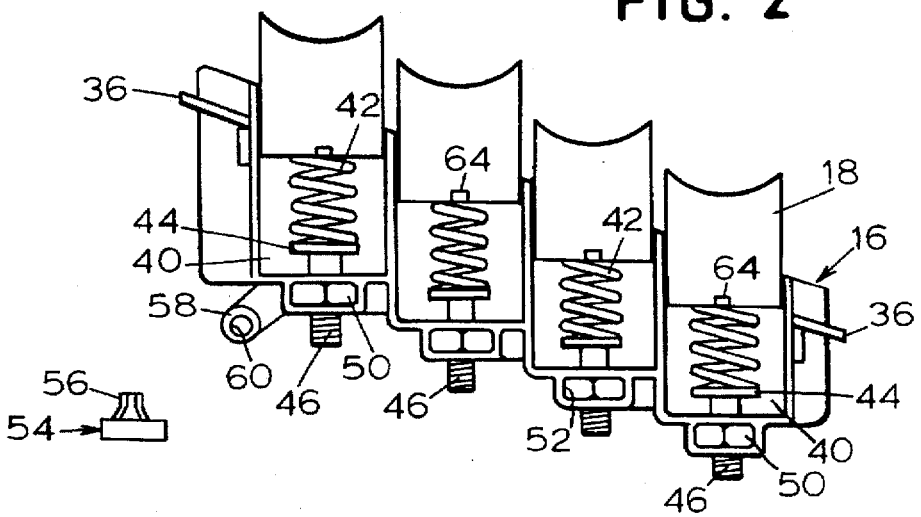

HAND DEVELOPMENT APPARATUS

BACKGROUND OF THE INVENTION

The invention relates to a hand development apparatus having a plurality of spring-loaded keys which may be individually depressed by the fingers of a person's hand to strengthen and develop the finger and hand muscles.

Various types of hand development devices have been designed for strengthening the hand and finger muscles. For example, U.S. Pat. No. 4,678,181 to John Ditsch, et al. discloses a hand development system having four spring-loaded depressible keys. Each of the keys is provided within a modular key cartridge which may include either one spring, to provide a relatively small resistance, or two springs, to provide a relatively large resistance. The system may be specially configured, by selected use of the key cartridges, according to the user's wishes.

U.S. Pat. No. 3,738,651 to Norman, et at. discloses a finger, hand and forearm developer having four spring-actuated plungers which are adapted to be depressed by the user's fingers. Each plunger is individually adjustable via a spring mechanism composed of a spring having a top end disposed within a cavity formed in the plunger and a threaded member against which the bottom portion of the spring rests. By rotating the threaded member, the elevation of the lower end of the spring is changed, thus causing the initial compression of the spring to be different.

SUMMARY OF THE INVENTION

The invention is directed to a hand development apparatus having a plurality of movable members or keys which may be individually depressed by the fingers of a person's hand to strengthen and develop the finger and hand muscles.

In one aspect of the invention, the hand development apparatus is provided with a first housing having an interior cavity formed therein and a gripping portion adapted to fit the palm of a person's hand and a second housing having an interior cavity formed therein and a gripping portion adapted to fit the palm of a person's hand. The apparatus has a carrier adapted to be removably fitted within the interior cavity of the first housing or within the interior cavity of the second housing, a plurality of movable elements associated with the carrier, the movable elements being adapted to accommodate the fingers of a person's hand and being movable along a movement direction, and means for resisting movement of the movable elements along the movement direction.

The width of the first housing is substantially different than the width of the second housing so that the apparatus may be configured either for a person having relatively large hands or a person having relatively small hands.

The means for resisting movement of the movable elements may comprise a spring mechanism for each of the movable elements, the spring mechanisms being disposed in the carrier and each of the spring mechanisms including a spring and means for adjusting the compression of the spring. The means for adjusting the compression of the spring may include an adjustment tool, and the hand development apparatus may be provided with means for supporting the adjustment tool.

In another aspect, the invention is directed to a hand development apparatus having a housing with an interior cavity formed therein and a gripping portion adapted to fit the palm of a person's hand, a carrier disposed within the interior cavity of the housing, a plurality of movable elements associated with the carrier and being adapted to accommodate the fingers of a person's hand, and means for resisting movement of the movable elements along the movement direction.

The movable elements are movable along the movement direction from an extended position to a compressed position and are carried by the carrier in a staggered relationship when in their extended positions. In the staggered relationship, each movable element lies at a unique position with respect to a plane perpendicular to the movement direction.

The movable elements may include a first movable element located at a first distance from the plane perpendicular to the movement direction, a second movable element adjacent the first movable element and being located at a second distance from the plane, a third movable element adjacent the second movable element and being located at a third distance from the plane, and a fourth movable element adjacent the third movable element and being located at a fourth distance frown the plane. The first distance may be greater than the second distance; the second distance may be greater than the third distance; and the third distance may be greater than the fourth distance. The movable elements may be positioned in the staggered relationship so that the incremental positional difference between each pair of adjacent elements is substantially the same.

These and other features and advantages of the present invention will be apparent to those of ordinary skill in the art in view of the detailed description of the preferred embodiment, which is made with reference to the drawings, a brief description of which is provided below.

BRIEF DESCRIPTION OF THE DRAWINGS

FIG. 1 is a side elevational view of a preferred embodiment of a hand development apparatus in accordance with the invention;

FIG. 2 is a side elevational view of a portion of the internal structure of the apparatus of FIG. 1;

DETAILED DESCRIPTION OF A PREFERRED EMBODIMENT

Figure 3A:
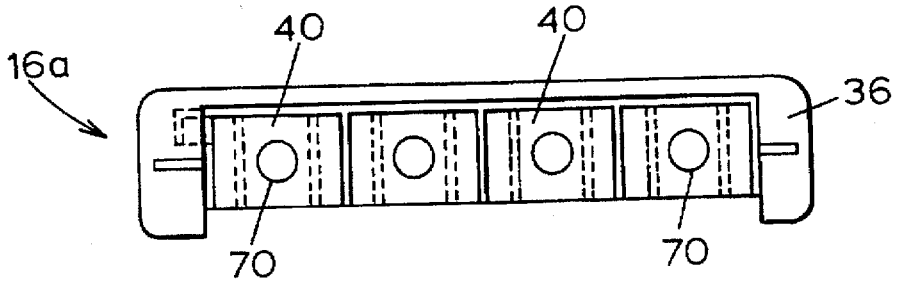
FIGS. 3A and 3B illustrate the structure of a first portion of a carrier shown in FIG. 2.

A preferred embodiment of a hand development apparatus 10 is illustrated in FIG. 1. Referring to FIG. 1, the apparatus 10 has a lower housing 12 having an internal cavity 14 in which a carrier 16 is removably disposed. Four movable members or keys 18 are disposed within the carrier 16 and are movable between an extended position (the position shown in FIG. 1) and a compressed position. The keys 18 have curved gripping surfaces 19 to facilitate gripping of the keys 18 by the fingers of a person. The apparatus 10 includes an upper housing 20 having an internal cavity 22 which may be disposed over the keys 18.

When in their extended positions, the keys 18 are positioned in a staggered relationship, each of the keys 18 occupying a different relative position relative to a plane perpendicular to the direction of movement of the keys 18, with the incremental positional difference between each pair of adjacent keys 18 being substantially the same.

Each housing 12, 20 is symmetrical and has a first housing portion generally in the shape of a parallelogram, with a first pair of substantially parallel sides 24, 26 and a second pair of substantially parallel sides 28, 30. The sides 24, 28 meet at an acute angle; the sides 26, 28 meet at an obtuse angle; and the sides 26, 30 meet at an acute angle. A second housing portion 32 extends from the parallelogram-shaped first housing portion. The upper face 24 of the housing 20 and a curved face 34 of the housing portion 32 both may have knurled or uneven surfaces which act as gripping surfaces. The curved face 34 is formed on the second housing portion 32 to define an anchoring projection that extends over the juncture between the thumb and forefinger in "pistol grip" fashion to secure the gripping surfaces against the palm of a person's hand when the apparatus 10 is used for hand development, as described below.

The carrier 16 is adapted to fit snugly within either the upper housing 20 or the lower housing 12. When the carrier 16 is fully inserted into either housing 12, 20, a peripheral edge 36 of the carrier 16 abuts the side 26 of the housing 12 or 20 in which the carrier 16 is disposed. When the carrier 16 is disposed in the lower housing 12 as shown in FIG. 1, the upper housing 20 may be placed over the keys 18 and the upper portion of the carrier 16 to act as a cover for the apparatus 10 when not in use.

The upper housing 20 has a first width $W_1$ measured between two of its parallel sides 24, 26 which is substantially smaller than a second width $W_2$ measured between the corresponding sides of the lower housing 12. Because the widths of the housings 12, 20 are different, the apparatus 10 may be used in two configurations, a first configuration in which the carrier 16 is disposed within the housing 12, as shown in FIG. 1, for use by a person with relatively large hands (the distance between the curved gripping surfaces 19 and the gripping surface 24 of the housing 12 being relatively large), and a second configuration in which the carrier 16 is disposed within the housing 20 for use by a person with relatively small hands (the distance between the curved gripping surfaces 19 and the surface 24 of the housing 20 being relatively small).

Referring to FIG. 2, each of the keys 18 is disposed for up and down movement within a respective key chamber 40. Each key 18 is supported within its key chamber 40 by a spring mechanism composed of a spring 42 having an upper end disposed within a cavity formed in the underside of the key 18 and a lower end supported by a coupling member 44 which is supported on the upper end of a screw 46. The internal cavity of each of the keys 18 may have a cylindrical or partly cylindrical horizontal cross-section so that the upper end of each spring 42 is maintained in the center of its associated key 18. The coupling member 44 may be in the form of a hat, having a hollow upper cylindrical portion about which the lower end of the spring 42 is seated and into which the upper portion of the screw 46 extends.

Each screw 46 passes through a nut 50 having a threaded central bore. Each nut 50 is disposed in a nut chamber 52 (FIG. 3B) disposed directly below its associated key chamber 40. The nut chamber 52 is dimensioned small enough to prevent rotation of the nut 50 therein. A hexagonal adjusting orifice (not shown) is formed in the bottom end of each screw 46, and an adjustment tool 54 having a hexagonal upper adjusting member 56 may be carried by the carrier 16 via a holding arm 58 having a bore 60 formed therein. The adjustment tool 54 may be carried by the holding arm 58 by placing the adjusting member 56 snugly within the bore 60 of the holding arm 58.

Each of the keys 18 may be provided with a spring 42 having a unique spring coefficient so that the force required to depress each of the keys 18 is different. For example, the rightmost key 18 shown in FIG. 2 may be provided with a spring which is most easily compressed since that key, when the apparatus 10 is gripped, is depressed by the smallest finger of a person's hand.

The force required to depress each of the keys 18 may be adjusted, with the use of the adjustment tool 54, by placing the adjusting member 56 of the tool 54 in the hexagonal orifice in the bottom of one of the screws 46 and turning the screw 46. Rotation of the screw 46 will change the elevation of the upper end of the screw 46, and thus the elevation of the lower end of the spring 42, thereby either compressing the spring 42 or reducing its compression since the uppermost position of the keys 18 is fixed. Each key 18 has a mechanical stop 64 formed in two of its sides. Each stop 64 rides within a respective slot 66 (shown in FIGS. 3B and 4B), formed in opposing sides of the carrier 16, the lengths of which define the range of movement of the key 18.

Figure 3B:
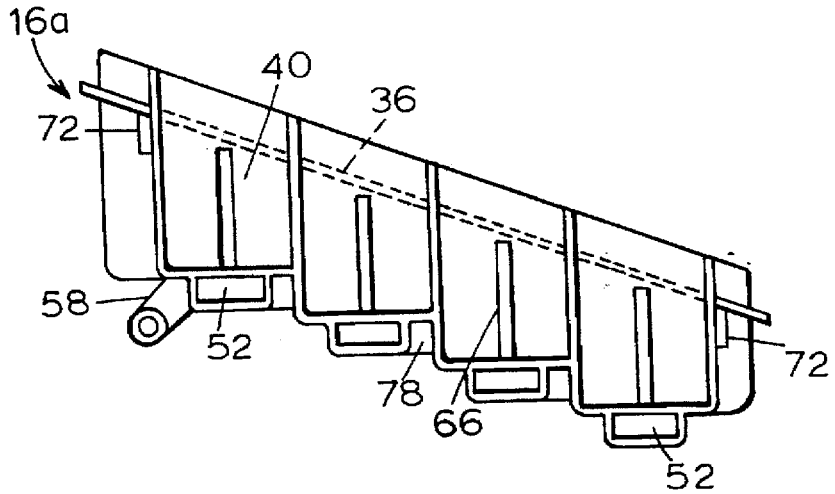

The carrier 16, which may be composed of injection-molded plastic, is composed of a pair of mating portions **16*a*, 16*b*. Referring to FIGS. 3A and 3B, the carrier portion 16*a* is composed of a single piece in which three side walls and the bottom wall of both the key chambers 40 and the nut chambers 52 are formed. The bottom wall of the key chamber 40 and the bottom wall of the nut chamber 52 each have a circular bore 70 formed therein to allow passage of the screws 46 therethrough. As shown in FIG. 3B, the carrier portion 16*a* has a pair of coupling slots 72 formed therein, each of which accommodates and holds a coupling tab 74 (FIGS. 4A and 4B) of the carrier portion 16*b* so that the carrier portions 16*a*, 16*b*** remain locked together after assembly.

Figure 4A:
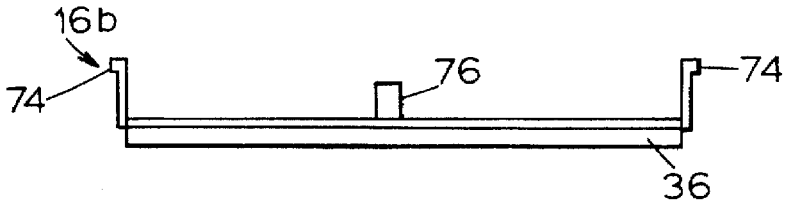
FIGS. 4A and 4B illustrate the structure of a second portion of the carrier shown in FIG. 2.
Figure 4B:
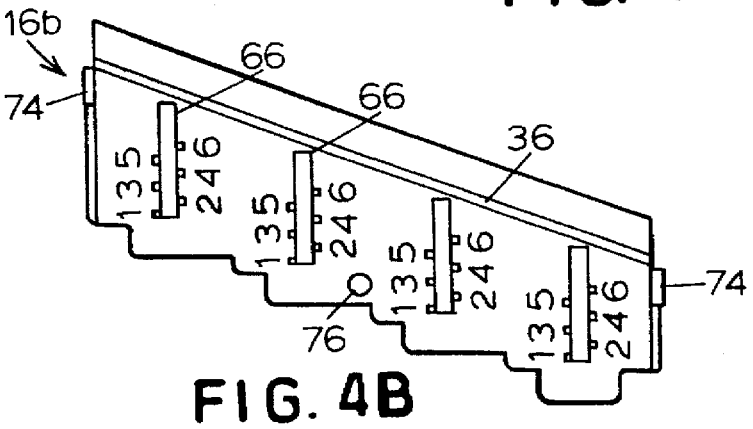

Referring to FIGS. 4A and 4B, the carrier portion **16*b* may be provided with a cylindrical positioning post 76 which may be disposed in a centrally located recess 78 formed between one of the key chambers 40 and one of the nut chambers 52. The carrier portion 16*b* may also be provided with numerals or other position-identifying indicia to provide an indication of the force settings of the springs 42**.

To assemble the apparatus 10, the nuts 50 are first disposed in their respective nut chambers 52 and the screws 46 are threaded through the nuts 50. The keys 18 are disposed in the carrier 16 one at a time by placing a coupling member 44 over the top end of a screw 46, inserting the top end of a spring 42 in the internal cavity within the key 18, placing the bottom end of the spring 42 over the top of the coupling member 44, and forcing the key 18 downwards until the mechanical stops 64 are positioned with the grooves. When the carrier portions **16*a*, 16*b* are composed of plastic, the resiliency of the plastic in combination with the relatively small outward extension of the stops 64 allow the keys 18 to be inserted into the carrier 16 when the carrier members 16*a*, 16*b*** are locked together.

In operation, the user grips the apparatus 10 by placing the palm of the hand over the gripping surface 24 with the anchoring projection defined by the second housing portion 32 overlying the portion of the top of the hand between the thumb and forefinger and extending toward the wrist such that the juncture of the thumb and forefinger abuts the curved grip portion 34 and each of the four fingers are positioned over the keys 18. Gripping the apparatus 10 in that manner, the keys 18 may be repeatedly depressed, overcoming the resistance provided by the springs 42, to develop the hand and finger muscles.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A hand development apparatus comprising:

a first housing having an interior cavity formed therein, said first housing comprising:

a first housing portion having a first pair of sides substantially parallel to each other and a second pair of sides substantially parallel to each other, one of said sides of said first pair being disposed at an acute angle relative to one of said sides of said second pair, said first housing portion having a first width measured between two of said substantially parallel sides;

a second housing portion which extends from said first housing portion;

a first gripping surface coincident with one of said sides of said first housing portion; and a second gripping surface disposed on said second housing portion, said first and second gripping surfaces being adapted to fit the palm of a person's hand;

a second housing having an interior cavity formed therein, said second housing wherein a person can selectively use one of said first and second housings that best fits the person's hand comprising:

a first housing portion having a first pair of sides substantially parallel to each other and a second pair of sides substantially parallel to each other, one of said sides of said first pair being disposed at an acute angle relative to one of said sides of said second pair, said first housing portion of said second housing having a second width measured between two of said substantially parallel sides of said second housing, said second width being substantially different than said first width;

a second housing portion which extends from said first housing portion of said second housing;

a first gripping surface coincident with one of said sides of said first housing portion of said second housing; and a second gripping surface disposed on said second housing portion of said second housing, said first and second gripping surfaces of said second housing being adapted to fit the palm of a person's hand;

a carrier alternately removably disposed within said interior cavity of one or the other of said first and second housings;

a plurality of movable elements carried by said carrier, said movable elements being adapted to accommodate the fingers of a person's hand and being movable along a movement direction, said movable elements being carried by said carrier in a staggered relationship wherein each of said movable elements lies at a different position with respect to a plane perpendicular to said movement direction; and a spring mechanism for resisting movement of each of said movable elements along said movement direction, said spring mechanisms being disposed in said carrier and each of said spring mechanisms including a spring and means for adjusting the compression of said spring.

2. A hand development apparatus as defined in claim 1 wherein said means for adjusting the compression of said spring comprises:

a screw threadably connected to said carrier;

a coupling member adapted to fit over an end of said screw and within an end of said spring.

3. A hand development apparatus as defined in claim 1 wherein said means for adjusting the compression of said spring comprises an adjustment tool and wherein said carrier additionally comprises means for supporting said adjustment tool.

4. A hand development apparatus as defined in claim 1 wherein one of said springs has a spring coefficient different than another of said springs.

5. A hand development apparatus comprising:

a first housing having an interior cavity formed therein, a gripping portion adapted to fit the palm of a person's hand, and a first width;

a second housing having an interior cavity formed therein, a gripping portion adapted to fit the palm of a person's hand, and a second width different than said first width;

a carrier alternately removably disposed within said interior cavity of one or the other of said first and second housings wherein a person can selectively use one of said first and second housings that best fits the person's hand.

6. A hand development apparatus as defined in claim 5 wherein said means for resisting movement of said movable elements comprises a spring mechanism for each of said movable elements, said spring mechanisms being disposed in said carrier and each of said spring mechanisms including a spring and means for adjusting the compression of said spring.

7. A hand development apparatus as defined in claim 6 wherein said means for adjusting the compression of said spring comprises:

a screw threadably connected to said carrier;

a coupling member adapted to fit over an end of said screw and within an end of said spring.

8. A hand development apparatus as defined in claim 6 wherein said means for adjusting the compression of said spring comprises an adjustment tool, said hand development apparatus additionally comprising means for supporting said adjustment tool.

9. A hand development apparatus as defined in claim 5 wherein said movable elements are carried by said carrier in a staggered relationship wherein each of said movable elements are spaced on axes which are parallel to said movement direction.

10. A hand development apparatus as defined in claim 5 wherein one of said springs has a spring coefficient different than another of said springs.

11. A hand development apparatus comprising:

a generally parallelogram shaped housing having an interior cavity formed therein and a gripping portion adapted to fit the palm of a person's hand said housing having a first pair of sides substantially parallel to each other and a second pair of sides substantially parallel to each other and one of said sides of said first pair being disposed at an acute angle relative to one of said sides of said second pair;

a carrier removably disposed within said interior cavity of said housing;

a plurality of substantially identically sized movable elements associated with said carrier, said movable elements being adapted to accommodate the fingers of a person's hand and being movable along a movement direction from an extended position to a compressed position, said movable elements being carried by said carrier in an inclined stair-step staggered relationship substantially parallel to said first pair of sides of said housing when said movable elements are in said extended positions, wherein each of said movable elements lies at a sucessively different position with respect to a plane perpendicular to said movement direction; means, operatively connected between said carrier and said movable elements, for limiting said movable elements to have the same range of motion between the extended positions and the compressed positions; and means for resisting movement of said movable elements along said movement direction.

12. A hand development apparatus as defined in claim 11 wherein said movable elements comprise:

a first movable element having a gripping surface located at a first distance from said plane when said first movable element is in said extended position;

a second movable element adjacent said first movable element, said second movable element having a gripping surface located at a second distance frown said plane when said second movable element is in said extended position;

a third movable element adjacent said second movable element, said third movable element having a gripping surface located at a third distance from said plane when said third movable element is in said extended position; and a fourth movable element adjacent said third movable element, said fourth movable element having a gripping surface located at a fourth distance from said plane when said fourth movable element is in said extended position, and wherein said first distance is greater than said second distance, said second distance is greater than said third distance, and said third distance is greater than said fourth distance.

13. A hand development apparatus as defined in claim 12 wherein said movable elements are positioned in said staggered relationship so that, when said movable elements are in said extended position, a first difference between said first and second distances is substantially equal to a second difference between said second and third distances and to a third difference between said third and fourth distances.

14. A hand development apparatus as defined in claim 11 wherein said housing comprises:

a first housing portion having a first pair of sides substantially parallel to each other and a second pair of sides substantially parallel to each other, one of said sides of said first pair being disposed at an acute angle relative to one of said sides of said second pair; and a second housing portion which extends from said first housing portion to define an anchoring projection adapted to extend over the juncture between the thumb and forefinger to secure said housing against the palm of a person's hand.

15. A hand development apparatus as defined in claim 14 wherein said second housing portion extends from said first housing portion in a direction substantially parallel to said movement direction.

16. A hand development apparatus as defined in claim 11 additionally comprising a second housing having an interior cavity formed therein, said second housing comprising:

a first housing portion having a first pair of sides substantially parallel to each other and a second pair of sides substantially parallel to each other, one of said sides of said first pair being disposed at an acute angle relative to one of said sides of said second pair; and a second housing portion which extends from said first housing portion of said second housing.

17. A hand development apparatus as defined in claim 11 wherein said means for resisting movement of said movable elements comprises a spring mechanism for each of said movable elements, said spring mechanisms being disposed in said carrier and each of said spring mechanisms including a spring and means for adjusting the compression of said spring.

18. A hand development apparatus as defined in claim 17 wherein said means for adjusting the compression of said spring comprises:

a screw threadably connected to said carrier;

a coupling member adapted to fit over an end of said screw and within an end of said spring.

19. A hand development apparatus as defined in claim 17 wherein said means for adjusting the compression of said spring comprises an adjustment tool, said hand development apparatus additionally comprising means for supporting said adjustment tool.

20. A hand development apparatus as defined in claim 17 wherein one of said springs has a spring coefficient different than another of said springs.

* * * * *

UNITED STATES PATENT AND TRADEMARK OFFICE

CERTIFICATE OF CORRECTION

PATENT NO. : 5,690,585

DATED : November 25, 1997

INVENTOR : John R. Ditsch

It is certified that error appears in the above-identified patent and that said Letters Patent is hereby corrected as shown below:

Column 2, line 19, please delete "frown" and insert in its place --from--;

Column 6, line 23, please delete "." and insert in its place --;

a plurality of movable elements associated with said carrier, said movable elements being adapted to accommodate the fingers of a person's hand and being movable along a movement direction; and means for resisting movement of said movable elements along said movement direction.--

Column 7, line 20, please delete "frown" and insert in its place --from--;

Signed and Sealed this

Eighteenth Day of April, 2000

*Attest:*

Q. TODD DICKINSON

*Attesting Officer*

*Director of Patents and Trademarks*